US007561842B2

(12) United States Patent
Takahashi

(10) Patent No.: US 7,561,842 B2
(45) Date of Patent: Jul. 14, 2009

(54) GROOVED FIXING BELT, FIXING UNIT AND IMAGE FORMING APPARATUS

(75) Inventor: Koji Takahashi, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 11/253,692

(22) Filed: Oct. 20, 2005

(65) Prior Publication Data

US 2006/0269334 A1 Nov. 30, 2006

(30) Foreign Application Priority Data

May 30, 2005 (JP) ..... 2005-156540

(51) Int. Cl.
*G03G 15/16* (2006.01)

(52) U.S. Cl. ..... 399/329

(58) Field of Classification Search ..... 399/329
See application file for complete search history.

(56) References Cited

U.S. PATENT DOCUMENTS

2005/0185988 A1* 8/2005 Mochimaru ..... 399/329

FOREIGN PATENT DOCUMENTS

JP 10198200 A * 7/1998
JP 2001-341143 12/2001
JP 2002-025759 1/2002
JP 2002-357968 12/2002
JP 2005-084484 3/2005
JP 2005091557 A * 4/2005

OTHER PUBLICATIONS

Machine translation of JP 2002-025759 A.*
Machine translation of JP 2005-003781 A.*
Office Action for JP 2005-156540 and its English translation.
Notification of Reasons for Refusal issues in corresponding Japanese Patent Application No. 2005-156540, mailed May 26, 2008, and translation thereof.

* cited by examiner

*Primary Examiner*—David M Gray
*Assistant Examiner*—Ruth N Labombard
(74) *Attorney, Agent, or Firm*—Buchanan Ingersoll & Rooney PC

(57) ABSTRACT

In a fixing unit which drivingly rotates an endless fixing belt having a lubricant applied to an inside surface thereof and which presses the fixing belt against a recording medium formed with a toner image thereon thereby fixing the toner image to the recording medium, the inside surface of the fixing belt is formed with a plurality of grooves extended along a circumferential direction of the fixing belt or extended from a widthwise center of the fixing belt toward the opposite ends thereof as inclined in a moving direction of the fixing belt.

15 Claims, 19 Drawing Sheets

GROOVED FIXING BELT, FIXING UNIT AND IMAGE FORMING APPARATUS

RELATED APPLICATION

This application is based on application No. 15640/2005 filed in Japan, the contents of which are hereby incorporated by reference.

BACKGROUND OF THE INVENTION

1. Field of the Invention

The present invention relates to a fixing belt used in image forming apparatuses such as electrophotographic copiers and printers for fixing a toner image, formed on a recording medium, to the recording medium; a fixing unit employing the fixing belt; and an image forming apparatus employing the fixing unit. More particularly, the invention relates to an arrangement wherein the fixing belt with a lubricant applied to its inside surface is driven into rotation and is pressed against the recording medium formed with the toner image thereon so as to fix the toner image to the recoding medium, and is characterized by preventing the lubricant applied to the inside surface of the fixing belt from leaking out of the belt.

2. Description of the Related Art

In the image forming apparatuses such as electrophotographic copiers and printers, it has been a conventional practice to fix the toner image, formed on the recording medium, to the recording medium by means of the fixing unit.

Conventionally, various types of fixing units have been used for fixing the toner image, formed on the recording medium, to the recording medium.

One of such fixing units has the following arrangement as shown in FIG. 1. An endless fixing belt 21 is pressed against a rotating pressure roller 23 by means of a pressing member 22 disposed at place inside of an inside surface of the fixing belt. In conjunction with the rotation of the pressure roller 23, the fixing belt 21 is driven into rotation by way of a force of friction between the pressure roller 23 and the fixing belt 21. On the other hand, a heat roller 24 containing therein a heating element 24*a* is disposed at place inside of the inside surface of the fixing belt, so that the fixing belt 21 is heated by the heat roller 24.

In the fixing unit, a sheet-like recording medium 9 formed with a toner image t thereon is oriented in a manner to present the toner image t to the fixing belt 21 and is guided into space between the fixing belt 21 and the pressure roller 23. The recording medium 9 is heated and pressurized as sandwiched between the fixing belt 21 and the pressure roller 23, whereby the toner image t is fixed to the recording medium 9.

In the fixing unit employing such a fixing belt 21, the following measure is generally taken to ensure that the above fixing belt 21 is properly driven into rotation in conjunction with the rotation of the pressure roller 23. That is, a lubricant, such as a grease, is previously applied to the inside surface of the fixing belt 21 so as to reduce frictional resistance between the fixing belt 21 and the pressing member 22.

Even in the case where the lubricant such as a grease is applied to the inside surface of the fixing belt 21, the following problem is encountered. The lubricant is decreased in quantity because the pressure exerted by the pressing member 22 causes the lubricant to leak from the inside surface of the fixing belt 21. Consequently, frictional resistance between the fixing belt 21 and the pressing member 22 is increased so that the fixing belt 21 is not smoothly driven into rotation. Hence, slippage between the pressure roller 23 and the fixing belt 21 occurs to disturb the toner image t to be fixed to the recording medium 9 or to cause the recording medium 9 to be jammed between the fixing belt 21 and the pressure roller 23.

More recently, therefore, there have been proposed a fixing unit wherein the inside surface of the aforesaid fixing belt is roughened so as to retain the lubricant such as a grease (Japanese Unexamined Patent Publication No. 2001-341143), and a fixing unit wherein the inside surface of the fixing belt is formed with recesses for retaining the lubricant such as a grease (Japanese Unexamined Patent Publication No. 2002-25759).

However, even in the case where the inside surface of the fixing belt is roughened or formed with the recesses for retaining the lubricant such as a grease, the lubricant applied to the inside surface of the fixing belt gradually leaks from the widthwise opposite ends of the fixing belt because of the pressure exerted by the pressing member. While the fixing belt is used over an extended period of time, therefore, the slippage between the pressure roller and the fixing belt still occurs to disturb the toner image to be fixed to the recording medium or to cause the recording medium to be jammed between the fixing belt and the pressure roller. Thus, the fixing units are unable to provide consistent image fixation over an extended period of time.

SUMMARY OF THE INVENTION

It is an object of the invention to solve the aforementioned problem encountered when the toner image formed on the recording medium is fixed to the recording medium by means of the fixing unit employing the fixing belt. Specifically, in the case where the lubricant such as a grease is applied to the inside surface of the fixing belt, the invention is directed to prevent the leakage of the lubricant from the fixing belt so as to ensure the consistent image fixation over an extended period of time.

A fixing belt according to the invention is used in a fixing unit which drivingly rotates an endless fixing belt having the lubricant applied to the inside surface thereof and which presses the fixing belt against a recording medium formed with a toner image thereon thereby fixing the toner image to the recording medium, wherein the inside surface of the fixing belt is formed with a plurality of grooves extended along a circumferential direction of the fixing belt or extended from a widthwise center of the fixing belt toward the opposite ends thereof as inclined in a moving direction of the fixing belt.

A fixing unit according to the invention comprises: an endless fixing belt having a lubricant applied to an inside surface thereof; a driver for drivingly rotating the fixing belt; and a pressing member for pressing the fixing belt on the inside surface thereof thereby pressing the fixing belt against a recording member, wherein the inside surface of the fixing belt is formed with a plurality of grooves extended along a circumferential direction of the fixing belt or extended from a widthwise center of the fixing belt toward the opposite ends thereof as inclined in a moving direction of the fixing belt.

An image forming apparatus according to the invention comprises: an image carrier; an electrostatic latent image forming unit for forming an electrostatic latent image on the image carrier; a developing device for forming a toner image on the image carrier by developing the electrostatic latent image; a transfer unit for transferring the toner image from the image carrier to a recording member; and a fixing unit for fixing the transferred toner image to the recording member, wherein the fixing unit comprises: an endless fixing belt having a lubricant applied to an inside surface thereof; a driver for drivingly rotating the fixing belt; and a pressing member for pressing the fixing belt on the inside surface thereof thereby pressing the fixing belt against the recording member, the inside surface of the fixing belt formed with a plurality of grooves extended in a circumferential direction of the fixing belt or extended from a widthwise center of the fixing belt toward the opposite ends thereof as inclined in a moving direction of the fixing belt.

The following advantage may be obtained by forming the plural grooves in the inside surface of the fixing belt where the lubricant is applied, the grooves extended along the circumferential direction of the fixing belt, as described above. When the toner image is fixed to the recording medium by pressing the fixing belt, being drivingly rotated, against the recording medium formed with the toner image thereon, the lubricant applied to the inside surface of the fixing belt is retained in the aforesaid plural grooves extended along the circumferential direction. As a result, the lubricant is properly prevented from leaking from the widthwise opposite ends of the fixing belt.

Furthermore, the following advantage may be obtained by forming the plural grooves in the inside surface of the fixing belt where the lubricant is applied, the grooves extended from the widthwise center of the fixing belt toward the opposite ends thereof as inclined in the moving direction of the fixing belt. When the toner image is fixed to the recording medium by pressing the fixing belt, being drivingly rotated, against the recording medium formed with the toner image thereon, the lubricant applied to the inside surface of the fixing belt is guided to the widthwise center of the fixing belt via the grooves extended from the widthwise center toward the opposite ends as inclined in the moving direction of the fixing belt. As a result, the lubricant is more assuredly prevented from leaking from the widthwise opposite ends of the fixing belt.

As suggested by the fixing unit according to the invention, the following advantage may be obtained by using the aforementioned fixing belt in a case where the endless fixing belt with the lubricant applied to the inside surface thereof is drivingly rotated and is pressed against the recording medium formed with the toner image thereon for fixing the toner image to the recording medium. That is, the lubricant applied to the inside surface of the fixing belt is prevented from leaking from the widthwise opposite ends of the fixing belt, as described above. Thus is obviated the problem encountered by the conventional fixing units, that the lubricant leaks from the widthwise opposite ends of the fixing belt, disabling the proper drivable rotation of the fixing belt. As a result, the toner image to be fixed to the recording medium is prevented from suffering disturbances or the recording medium is prevented from being jammed. Hence, the consistent image fixation may be ensured over an extended period of time, so that favorable image formation may be provided over an extended period of time.

As suggested by the image forming apparatus according to the invention, the following advantages may be obtained by employing the aforementioned fixing unit for fixing the toner image to the recording medium. The toner image to be fixed to the recording medium is prevented from suffering disturbances or the recording medium is prevented from being jammed. Hence, the consistent image fixation may be ensured over an extended period of time, so that favorable image formation may be provided over an extended period of time.

These and other objects, advantages and features of the invention will become apparent from the following description taken in conjunction with the accompanying drawings which illustrate specific embodiments of the invention.

DESCRIPTION OF THE PREFERRED EMBODIMENTS

Next, fixing belts, fixing units and image forming apparatuses according to the invention will be specifically described with reference to the accompanying drawings. It is noted that the fixing belt, the fixing unit and the image forming apparatus according to the invention are not limited to those illustrated by the following embodiments hereof but may be practiced with proper changes made thereto so long as such changes do not deviated from the scope of the invention.

Figure 2:
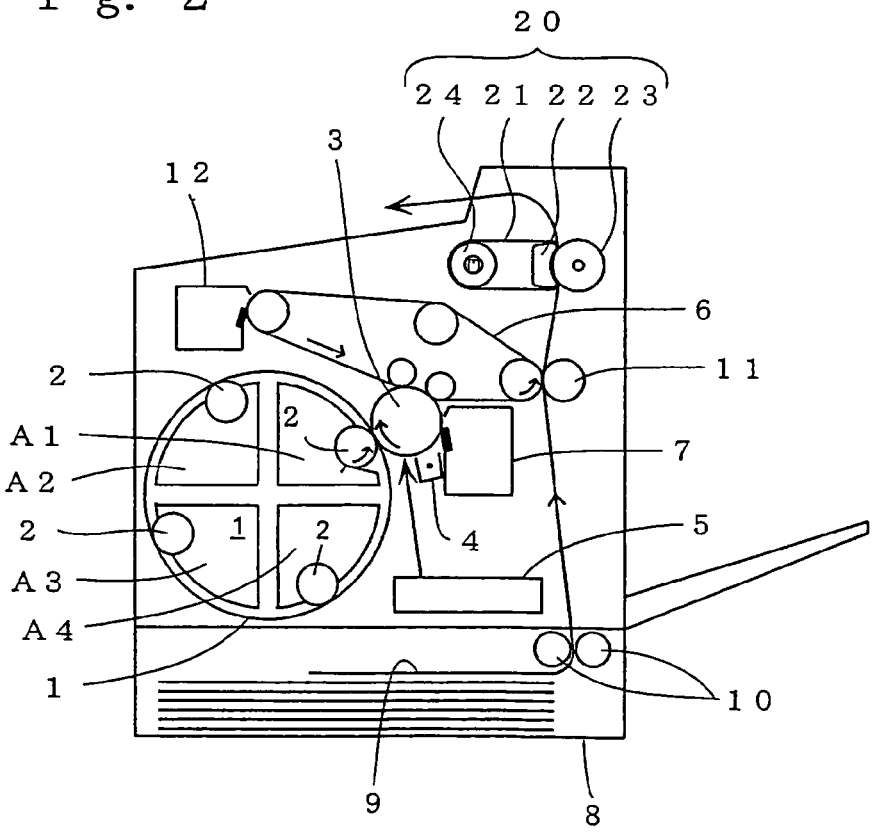
FIG. 2 is a schematic diagram illustrating an image forming apparatus according to an embodiment of the invention.

In the image forming apparatus according to the embodiment, four developing devices A1 to A4 containing therein a yellow toner, a magenta toner, a cyan toner and a black toner, respectively, are retained by a rotatable holder 1, as shown in FIG. 2. The holder 1 is rotated for shifting the developing devices A1 to A4 in turn so as to position the respective developing devices A1 to A4 at place where a respective toner carrier 2 of the developing devices A1 to A4 opposes an image carrier 3. In a development region where the toner carrier 2 opposes the image carrier 3, the toner carrier 2 is allowed to supply the toner to the image carrier 3.

The image forming apparatus forms an image color as follows. For instance, the toner carrier 2 of a first developing device A1 containing therein the yellow toner is first positioned to oppose the image carrier 3. The image carrier 3 is rotated so that a surface of the image carrier 3 may be uniformly charged by a charger 4. Based on an image signal, an exposure unit 5 irradiates light on the image carrier 3 thus charged, thereby forming an electrostatic latent image on the surface of the image carrier 3.

In the development region where the image carrier 3 thus formed with the electrostatic latent image thereon is opposed by the toner carrier 2 of the first developing device A1, the toner carrier 2 supplies the yellow toner to an area of the electrostatic latent image formed on the image carrier 3, thereby forming, on the image carrier 3, a yellow toner image corresponding to the electrostatic latent image.

Subsequently, the yellow toner image thus formed on the image carrier 3 is transferred onto a looped transfer belt over the image carrier 3. In the meantime, the yellow toner remaining on the image carrier 3 after the image transfer is removed from the image carrier 3 by means of a cleaner 7.

Then, the above holder 1 is rotated to shift the toner carrier 2 of a second developing device A2 to place opposite the image carrier 3, the second developing device A2 containing therein the magenta toner. A magenta toner image is formed on the surface of the image carrier 3 in a similar way to the toner image formation by the first developing device A1. The magenta toner image is transferred onto the transfer belt 6 with the yellow toner image transferred thereto. In the meantime, the magenta toner remaining on the image carrier 3 after the image transfer is removed from the image carrier 3 by means of the cleaner 7.

Subsequently, similar operations are performed to permit a third developing device A3 containing therein the cyan toner to from a cyan toner image on the surface of the image carrier 3. The cyan toner image is transferred onto the above transfer belt 6. Subsequently, a fourth developing device A4 containing therein the black toner is operated to form a black toner image on the surface of the image carrier 3, and the black toner image is transferred onto the above transfer belt 6. In this manner, a full-color toner image is formed by sequentially transferring the yellow, magenta, cyan and black toner images onto the transfer belt 6.

A sheet-like recording medium 9 is taken out from a sheet cassette 8 disposed at a lower part of the image forming apparatus and is guided into space between the transfer belt 6 and a transfer roller 11 by means of a feed roller 10. Thus, the full-color toner image formed on the transfer belt 6 is transferred onto the recording medium 9. The full-color toner image thus transferred onto the recording medium 9 is fixed to the recording medium 9 by means of a fixing unit 20 and then, is discharged from the apparatus. On the other hand, the toner remaining on the transfer belt 6 is removed from the transfer belt 6 by means of a cleaner 12.

Figure 1:
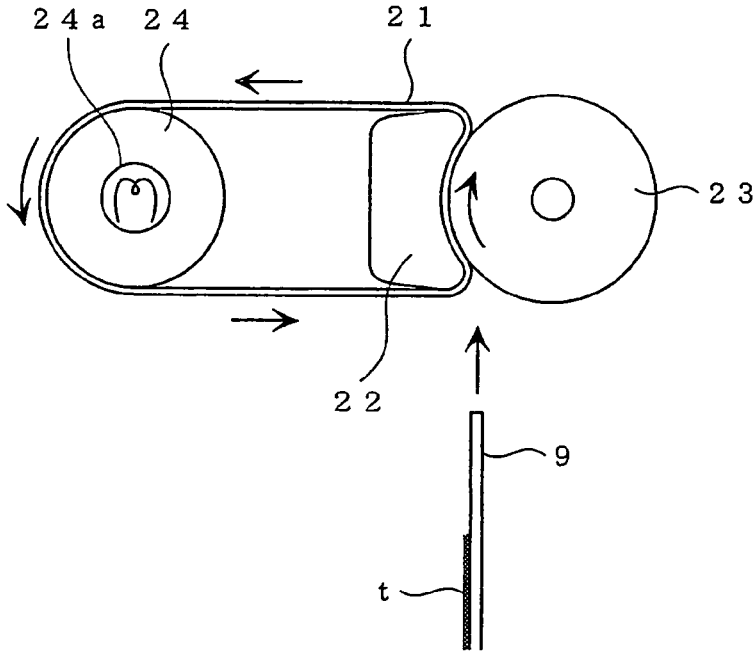
Fig. 1 Prior Art
FIG. 1 is a schematic diagram illustrating a fixing unit employing a fixing belt.

The above fixing unit 20 is arranged the same way as that shown in FIG. 1. An endless fixing belt 21 is pressed against a rotating pressure roller 23 by means of a pressing member 22 disposed at place inside of an inside surface of the endless belt. In conjunction with the rotation of the pressure roller 23, the fixing belt 21 is driven into rotation by way of a force of friction between the pressure roller 23 and the fixing belt 21. On the other hand, a heat roller 24 containing therein a heating element 24*a* is disposed at place inside of the inside surface of the fixing belt, so that the fixing belt 21 is heated by the heat roller 24.

The sheet-like recording medium 9 with the toner image t formed thereon is oriented in a manner to present the toner image t to the fixing belt 21 and is guided into space between the fixing belt 21 and the pressure roller 23. The recording medium 9 is heated and pressurized as sandwiched between the fixing belt 21 and the pressure roller 23, whereby the toner image t is fixed to the recording medium 9.

In this embodiment as well, the arrangement is made such as to ensure that the above fixing belt 21 is properly driven into rotation in conjunction with the rotation of the pressure roller 23. That is, a lubricant, such as a grease, is previously applied to the inside surface of the fixing belt 21 so as to reduce frictional resistance between the fixing belt 21 and the pressing member 22.

Figure 3:
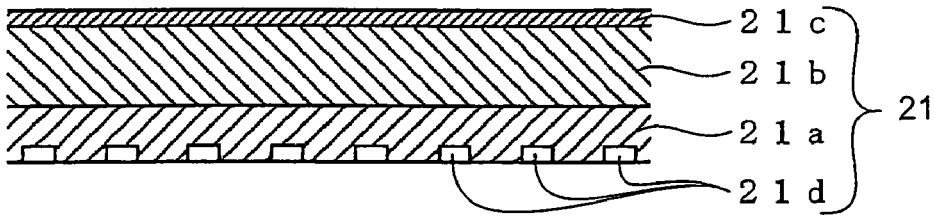
FIG. 3 is a sectional view illustrating a fixing belt used in the image forming apparatus according to the above embodiment.

It is noted here that the embodiment employs the following member as the aforesaid fixing belt 21. As shown in FIG. 3, the fixing belt has a three-lamination-layer structure including: an endless belt substrate 21*a* formed from a material having high heat resistance and strength, such as polyimide; an elastic layer 21*b* formed from an elastic material such as silicone rubber; and surface layer 21*c* formed from a fluorine resin or the like which is excellent in releasability to the toner. The elastic layer and the surface layer are overlaid on the belt substrate in this order. Furthermore, the fixing belt 21 is formed with grooves 21*d* in the inside surface thereof such as to retain the foresaid lubricant.

The following advantage may be obtained by using the fixing belt 21 of the aforementioned three-lamination-layer structure wherein the elastic layer 21*b* and the surface layer 21*c* are overlaid on the endless belt substrate 21*a*. In a case where the full-color toner image t including the laminate of the plural color toners is fixed to the recording medium 9, as described above, the aforesaid elastic layer 21*b* is properly deformed to permit the full-color toner image t to be properly fixed to the recording medium 9.

The following steps, for example, may be taken to form the above polyimide belt substrate 21*a* in the form of the endless belt. A solution of polyamide or of thermoplastic polyimide is coated on an outside surface of a cylindrical inner mold and is heat or vacuum dried to allow a solvent to volatilize. The resultant polyamide or polyimide is heated to a sinter temperature.

The following steps, for example, may be taken to overlay the elastic layer 21*b* of silicone rubber over the above belt substrate 21*a* in the form of the endless belt. A solution of silicon rubber is coated on the above belt substrate 21*a*. Subsequently, the resultant substrate is shaped and sintered.

The following steps, for example, may be taken to overlay the surface layer 21*c* of fluorine resin over the above elastic layer 21*b*. A solution of fluorine resin is coated on the above elastic layer 21*b*. Subsequently, the resultant laminate is shaped and sintered. Alternatively, a fluorine resin tube may be overlaid in a manner to cover an outside surface of the above elastic layer 21*b* and is made adhere to the outside surface of the elastic layer 21*b* by heating.

The grooves 21*d* for retaining the lubricant may be formed in the inside surface of the fixing belt in the following fashion. As described above, a plurality of grooves 21*d* maybe formed along a circumferential direction of the belt. Alternatively, a plurality of grooves 21*d* may be extended from a widthwise center of the fixing belt toward the opposite ends thereof as inclined in a moving direction of the fixing belt.

Figure 4:
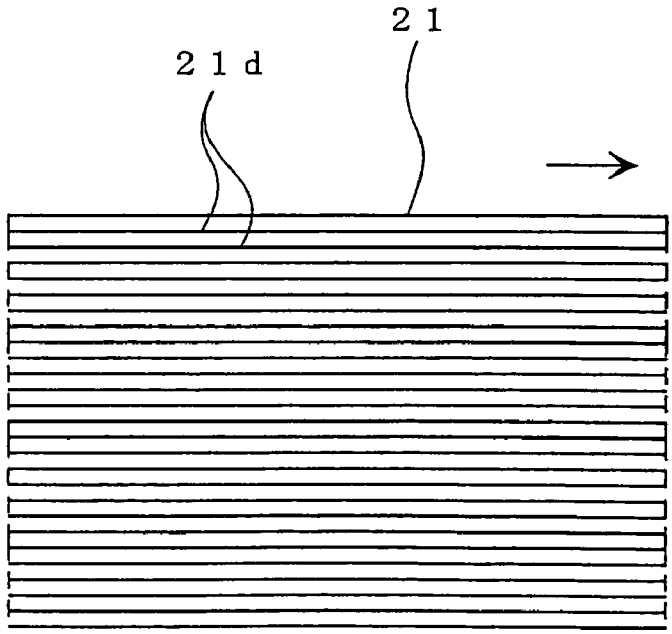
FIG. 4 is a fragmentary view showing a first example of grooves formed in an inside surface of the above fixing belt.
Figure 5:
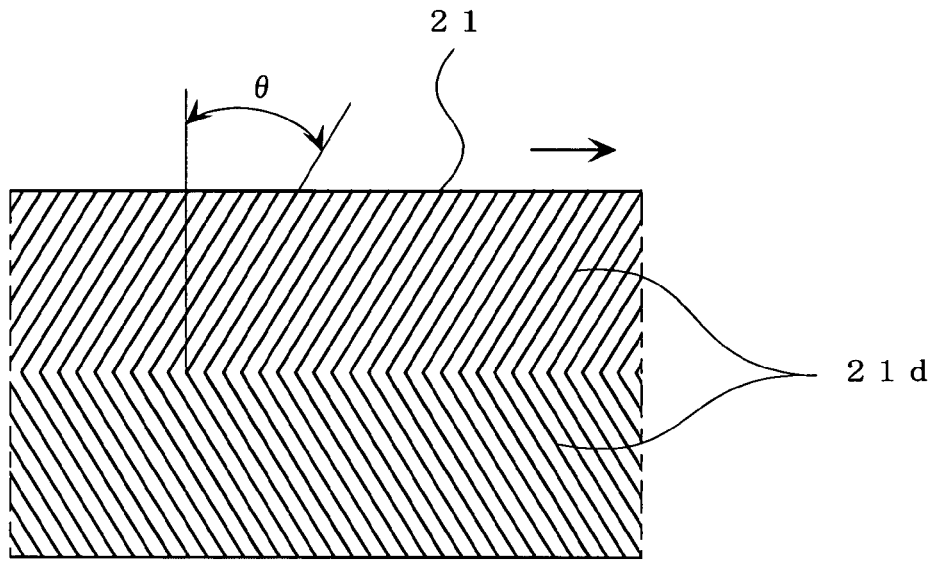
FIG. 5 is a fragmentary view showing a second example of the grooves formed in the inside surface of the above fixing belt.
Figure 6:
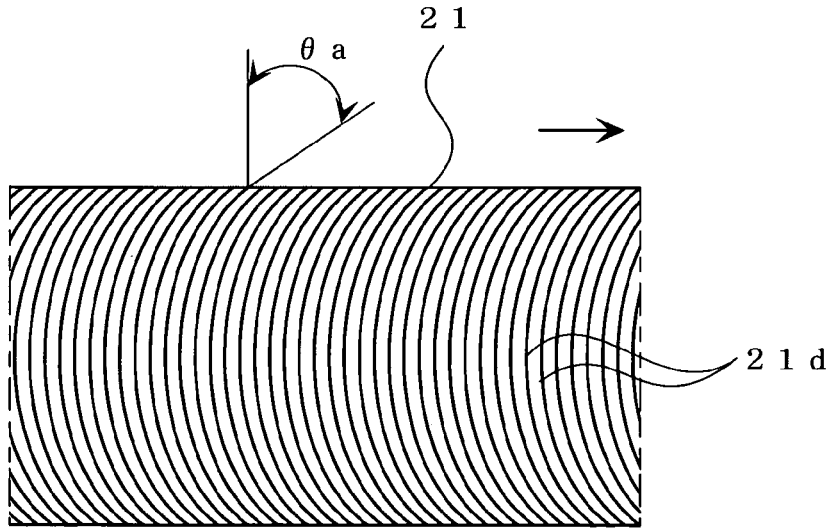
FIG. 6 is a fragmentary view showing a third example of the grooves formed in the inside surface of the above fixing belt.

Typical examples of the grooves 21*d* formed in the inside surface of the fixing belt 21 are shown in FIG. 4 to FIG. 6. According to an example of FIG. 4, the plural grooves 21*d* are extended for the overall circumferential length of the inside surface of the fixing belt 21 and along the circumferential direction thereof. The grooves are arranged in a widthwise direction of the fixing belt 21 at predetermined space intervals. In the case where the plural grooves 21*d* are formed in the inside surface of fixing belt 21 as extended along the circumferential direction thereof, the following advantage is obtained. When the fixing belt 21, being drivingly rotated, is pressed against the recording medium 9 formed with the toner image t thereon so as to fix the toner image t to the recording medium 9, as described above, the lubricant applied to the inside surface of the fixing belt 21 is retained in the grooves 21*d* extended along the aforesaid circumferential direction. Hence, the lubricant is prevented from leaking from the widthwise opposite ends of the fixing belt 21.

According to an example of FIG. 5, the fixing belt 21 is formed with plural V-shaped grooves 21*d* extended from the widthwise center of the fixing belt toward the opposite ends thereof as inclined in the moving direction of the fixing belt 21. The grooves are arranged in the circumferential direction of the fixing belt 21 at predetermined space intervals.

According to an example of FIG. 6, the fixing belt 21 is formed with plural grooves 21*d* extended from the widthwise center of the fixing belt toward the opposite ends thereof as inclined in the moving direction of the fixing belt 21 to define arcuate lines. The grooves are arranged in the circumferential direction of the fixing belt 21 at predetermined space intervals.

In the case where the plural grooves 21*d* are formed in the inside surface of fixing belt 21 as extended from the widthwise center thereof toward the opposite ends thereof and inclined in the moving direction of the fixing belt 21, as shown in FIG. 5 and FIG. 6, the following advantage is obtained. When the fixing belt 21, being drivingly rotated, is pressed against the recording medium 9 formed with the toner image t thereon thereby fixing the toner image t to the recording medium 9, the lubricant applied to the inside surface of the fixing belt 21 is guided to the widthwise center of the fixing belt 21 via the above grooves 21*d*. Hence, the lubricant is more positively prevented from leaking from the widthwise opposite ends of the fixing belt 21.

It is noted that the grooves 21*d* formed in the inside surface of the fixing belt 21 are not limited to those shown in FIG. 4 to FIG. 6 and may be formed in any fashion so long as the grooves 21*d* satisfy the aforementioned conditions of the invention.

Figure 7:
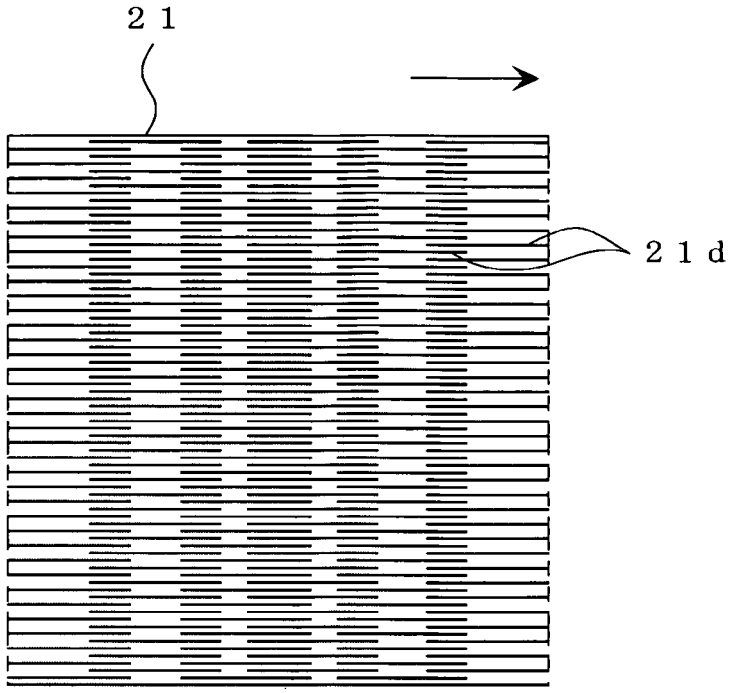
FIG. 7 is a fragmentary view showing a fourth example of the grooves formed in the inside surface of the above fixing belt.
Figure 8:
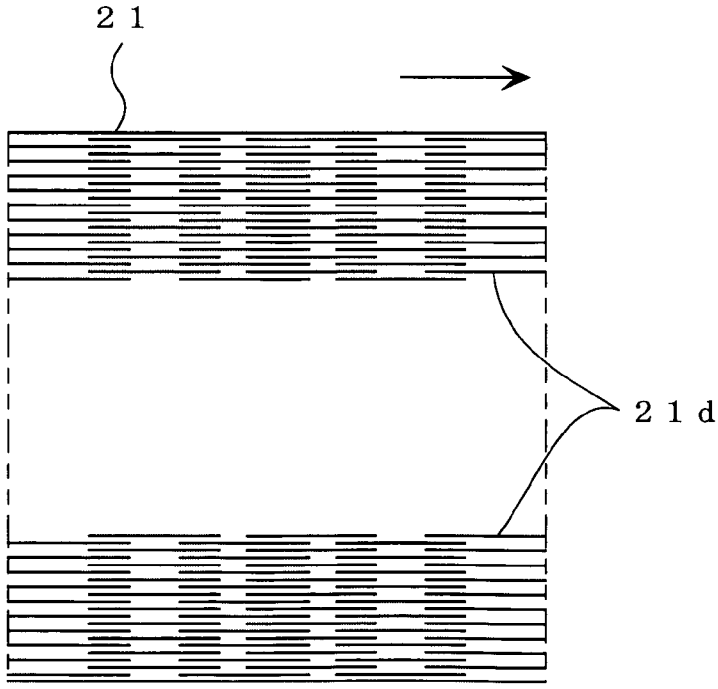
FIG. 8 is a fragmentary view showing a fifth example of the grooves formed in the inside surface of the above fixing belt.
Figure 9:
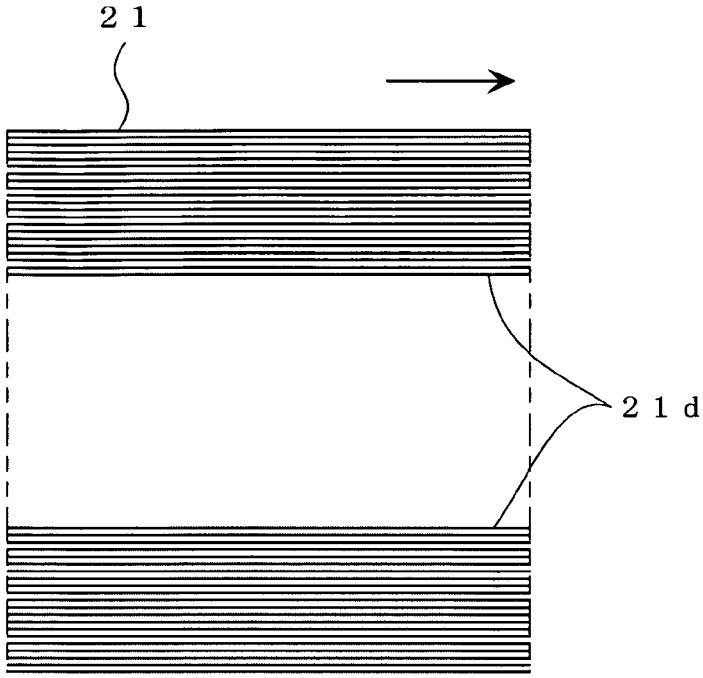
FIG. 9 is a fragmentary view showing a sixth example of the grooves formed in the inside surface of the above fixing belt.

The grooves 21*d* extended along the circumferential direction of the inside surface, as shown in FIG. 4, may be formed in the inside surface of the fixing belt 21 in various fashions. As shown in FIG. 7, for example, a plurality of grooves 21*d* extended for a predetermined length along the circumferential direction may be arranged across the overall width of the fixing belt 21 at predetermined space intervals. As shown in FIG. 8, a plurality of grooves 21*d* extended for a predetermined length along the circumferential direction may be arranged only in the widthwise opposite end regions of the fixing belt 21 at predetermined space intervals, so that a widthwise central region of the fixing belt 21 may be free from the grooves. As shown in FIG. 9, a plurality of grooves 21*d* extended for the overall circumferential length of the inside surface of the fixing belt 21 along the circumferential direction thereof may be arranged only in the widthwise opposite end regions of the fixing belt 21 at predetermined space intervals, so that the widthwise central region of the fixing belt 21 may be free from the grooves.

Figure 10:
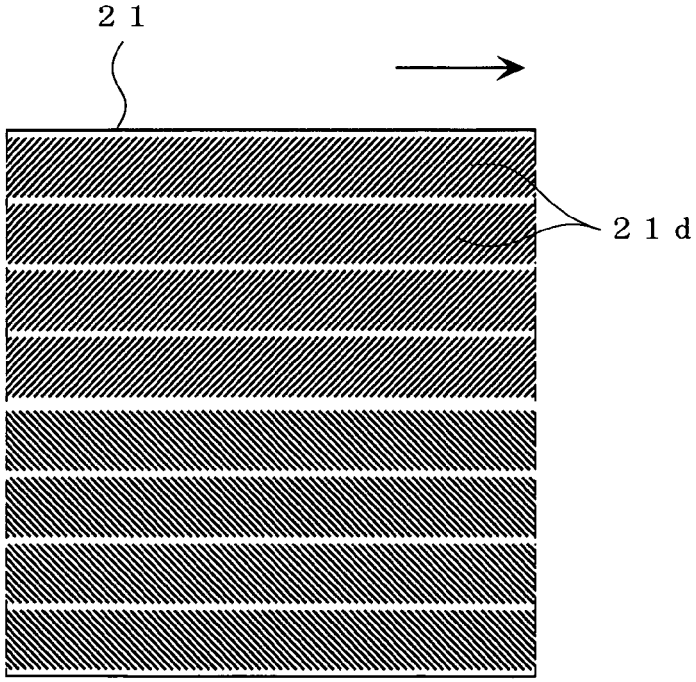
FIG. 10 is a fragmentary view showing a seventh example of the grooves formed in the inside surface of the above fixing belt.
Figure 11:
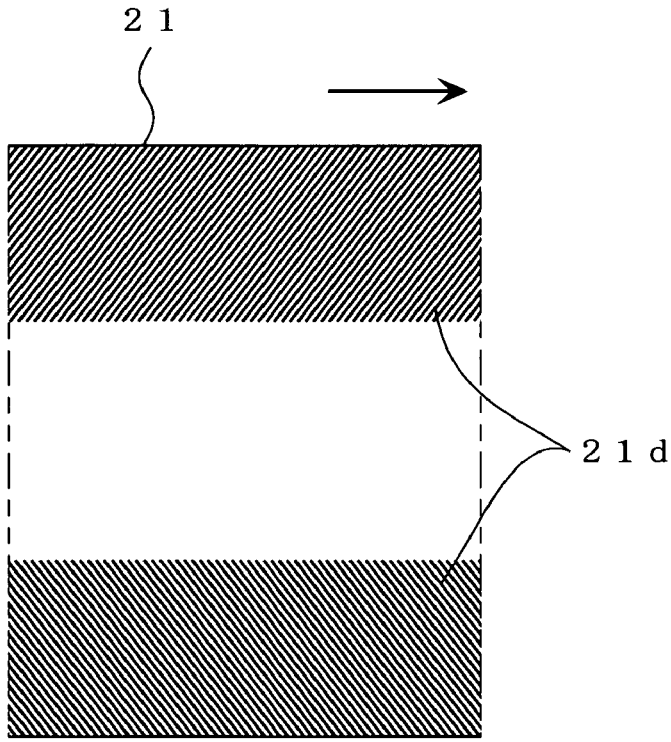
FIG. 11 is a fragmentary view-showing an eighth example of the grooves formed in the inside surface of the above fixing belt.

On the other hand, the grooves 21*d* extended from the widthwise center of the fixing belt 21 toward the opposite ends thereof as inclined in the moving direction thereof, as shown in FIG. 5, may be formed in the inside surface of the fixing belt 21 in various V-shape arrangements. As shown in FIG. 10, for example, a plurality of grooves 21*d* of a predetermined length, which are oriented from the widthwise center of the fixing belt 21 toward the either end thereof as inclined in the moving direction of the fixing belt 21, may be arranged in individual regions at predetermined space intervals, the regions laid across the overall width of the fixing belt. As shown in FIG. 11, a plurality of grooves 21*d* oriented from the widthwise center of the fixing belt 21 toward either end thereof as inclined in the moving direction thereof may be arranged only in the widthwise opposite end regions thereof at predetermined space intervals, so that the widthwise central region of the fixing belt 21 may be free from the grooves.

Furthermore, the grooves extended from the widthwise center of the fixing belt toward the opposite ends thereof as inclined in the moving direction thereof to define the arcuate lines, as shown in FIG. 6, may also be formed in the inside surface of the fixing belt 21 in various fashions. The arcuate grooves may be extended for a predetermined length. Alternatively, the arcuate grooves may be arranged only in the widthwise opposite end regions of the fixing belt 21 so that the widthwise central region thereof may be free from the grooves. What is required of the above grooves 21*d* is to be extended from the widthwise center of the fixing belt 21 toward the opposite ends thereof as inclined in the moving direction thereof, as described above. Hence, the groove may assume any configurations defined by parabola, hyperbola, a part of ellipse or any curve that satisfies the above conditions.

Consideration must be given to the following point when the grooves 21*d* are formed in the inside surface of the fixing belt as described above. If an area percentage of the grooves 21*d* based on the fixing belt 21 is too small, the grooves are incapable of retaining a sufficient amount of lubricant such as grease. If, on the other hand, the area percentage of the grooves 21*d* is too great, the fixing belt 21 is decreased in strength so that the fixing belt may be prone to breakage due to wear. It is therefore preferred that the area percentage of the grooves 21*d* based on the area of the inside surface of the fixing belt is limited to the range of 5% to 50%. In addition, it is preferred that the depth of the above grooves 21*d* is limited to the range of 4 to 3 μm and that the density of the grooves is defined to be 5 or more groove lines/mm.

If the above grooves 21*d* are too small in width, the grooves are incapable of retaining the sufficient amount of lubricant such as grease. If, on the other hand, the grooves 21*d* are too great in width, the fixing belt 21 may be decreased in strength or the grooves 21*d* may have an adverse effect that the toner image t is not properly fixed to the recording medium 9. It is therefore preferred to limit the width of the grooves 21*d* to the range of 10 to 80 μm.

The grooves 21*d* extended from the widthwise center of the fixing belt 21 toward the opposite ends thereof as inclined in the moving direction thereof, as shown in FIG. 5 and such, may preferably be defined as follows in order to ensure that the lubricant applied to the inside surface of the fixing belt 21 is properly guided to the widthwise center of the fixing belt 21 by means of the grooves 21*d*. The above grooves 21*d* inclined from the widthwise center of the fixing belt 21 toward the opposite ends thereof in the moving direction thereof may preferably have a tilt angle θ of 5° or more.

The aforementioned grooves 21*d* may be formed in the inside surface of the fixing belt 21 in the following manner. In the manufacture of the endless belt substrate 21*a*, projections corresponding to the above grooves 21*d* may be formed on the outside surface of the aforesaid cylindrical inner mold, such that the grooves 21*d* may be formed in parallel with the manufacture of the belt substrate 21*a*.

An alternative approach may also be taken. After the manufacture of the endless belt substrate 21*a* yet to be formed with the grooves 21*d*, the resultant belt substrate 21*a* is set on another inner mold which is formed with the projections corresponding to the grooves 21*d* on an outside surface thereof. Thus, the grooves 21*d* corresponding to the above projections may be formed in an inside surface of the belt substrate 21*a* while the elastic layer 21*b* and the surface layer 21*c* are overlaid on the substrate by sintering as described above.

As the aforesaid pressing member 22, there may be used a member including a reinforcing core, a substrate formed from a heat-resistant resin, an elastic layer formed from a silicone rubber or the like and a surface layer formed from a fluorine resin or the like, the substrate, elastic layer and surface layer overlaid on the reinforcing core.

As the aforesaid pressure roller 23, there may be used a roller which includes a core, an elastic layer formed from a silicone rubber or the like, and a surface layer formed from a fluorine resin or the like, the elastic layer and the surface layer overlaid on an outside surface of the core. The pressure roller 23 may contain therein a heating element (not shown).

As the aforesaid heat roller 24, there may be used a roller wherein the heating element 24*a* is disposed within a thin core formed from aluminum or the like.

Although not shown in the figure, the fixing belt 21 may also be heated by the following methods. Instead of using the above heat roller 24, a heating element may be disposed in the aforesaid pressing member 22 for heating the fixing belt 21. Alternatively, a dielectric material may be used in the fixing belt 21 such as to heat the fixing belt 21 by electromagnetic induction heating. An alternative arrangement may also be made such that instead of using the heat roller 24, a heating element is disposed within the pressure roller 23, as described above, for sufficiently heating the pressure roller 23, and that the recording medium 9 with the toner image t formed thereon is oriented in a manner to present the toner image t to the pressure roller 23 and is guided into space between the fixing belt 21 and the pressure roller 23.

A test was conducted using the fixing belts of the examples of the invention and fixing belts of comparative examples. The test demonstrates that the use of the fixing belts of the examples of the invention ensure that the consistent image fixation is provided over an extended period of time.

The following examples and comparative examples used the fixing belt 21, which had a three-lamination-layer structure including an endless belt substrate 21*a* formed from polyimide and having a thickness of 70 μm, an elastic layer 21*b* formed from silicone rubber and having a thickness of 150 μm, and a surface layer formed from a fluorine resin and having a thickness of 20 μm, the elastic layer and surface layer overlaid on the belt substrate. The fixing belt had a diameter of 50 mm and a belt width of 278 mm. The grooves 21*d* formed in the inside surface of the fixing belt 21 were varied in fashion.

EXAMPLE 1

In Example 1, a plurality of grooves 21*d* were formed in the inside surface of the fixing belt 21 as extended for the overall circumferential length thereof along the circumferential direction thereof, as shown in FIG. 4. The grooves 21*d* were arranged in the widthwise direction of the fixing belt 21 at predetermined space intervals.

The grooves 21*d* had a groove width of 80 μm, a groove depth of 30 μm and a density of 5 groove lines/mm.

EXAMPLES 2 to 6

In Examples 2 to 6, a plurality of V-shaped grooves 21*d* were formed in the inside surface of the fixing belt 21 as extended from the widthwise center of the fixing belt 21 toward the opposite ends thereof and inclined in the moving direction of the fixing belt 21, as shown in FIG. 5. The grooves 21*d* were arranged in the circumferential direction of the fixing belt 21 at predetermined space intervals.

In Example 2, the above grooves 21*d* were extended from the widthwise center of the fixing belt 21 toward the opposite ends thereof as inclined in the moving direction thereof at an angle θ of 45°. The grooves had a groove width of 30 μm, a groove depth of 15 μm and a density of 15 groove lines/mm.

In Example 3, the above grooves 21*d* were extended from the widthwise center of the fixing belt 21 toward the opposite ends thereof as inclined in the moving direction thereof at an angle θ of 5°. The grooves had a groove width of 40 μm, a groove depth of 15 μm and a density of 10 groove lines/mm.

In Example 4, the above grooves 21*d* were extended from the widthwise center of the fixing belt 21 toward the opposite ends thereof as inclined in the moving direction thereof at an angle θ of 85°. The grooves had a groove width of 40 μm, a groove depth of 25 μm and a density of 5 groove lines/mm.

In Example 5, the above grooves 21*d* were extended from the widthwise center of the fixing belt 21 toward the opposite ends thereof as inclined in the moving direction thereof at an angle θ of 45°. The grooves had a groove width of 10 μm, a groove depth of 4 μm and a density of 20 groove lines/mm.

In Example 6, the above grooves 21*d* were extended from the widthwise center of the fixing belt 21 toward the opposite ends thereof as inclined in the moving direction thereof at an angle θ of 5°. The grooves had a groove width of 10 μm, a groove depth of 4 μm and a density of 5 groove lines/mm.

EXAMPLE 7

In Example 7, a plurality of grooves 21*d* were formed in the inside surface of the fixing belt 21 as extended from the widthwise center of the fixing belt 21 toward the opposite ends thereof and inclined in the moving direction thereof to define the arcuate lines, as shown in FIG. 6. The grooves 21*d* were arranged in the circumferential direction of the fixing belt 21 at predetermined space intervals.

In Example 7, the grooves 21*d* inclined to define the arcuate lines had a curvature radius of 147 mm and a tilt angle θa of 30° relative to a tangent to each of the opposite ends of the fixing belt 21. The grooves had a groove width of 40 μm, a groove depth of 15 μm and a density of 10 groove lines/mm.

Comparative Example 1

Figure 12:
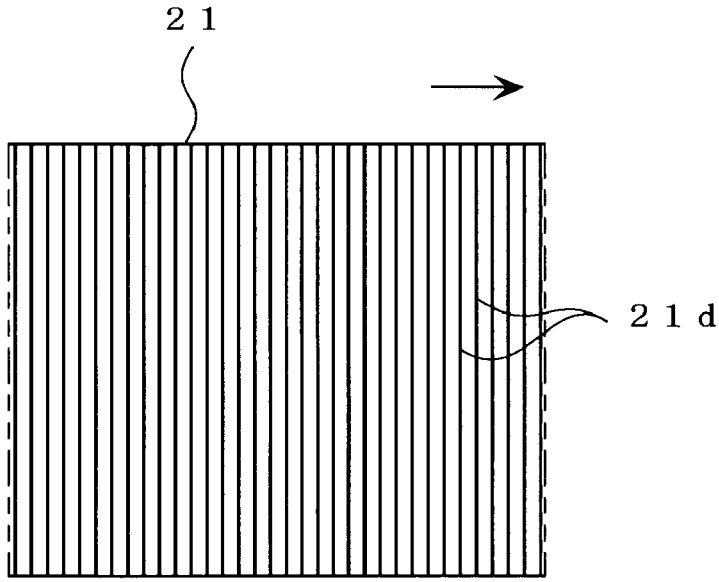
FIG. 12 is a fragmentary view showing grooves formed in an inside surface of a fixing belt according to Comparative Example 1.

In Comparative Example 1, a plurality of grooves 21*d* were formed in the inside surface of the fixing belt 21 in parallel to the widthwise direction of the fixing belt 21, as shown in FIG. 12. The grooves were arranged in the circumferential direction of the fixing belt 21 at predetermined space intervals. The grooves 21*d* had a groove width of 40 μm, a groove depth of 10 μm and a density of 10 groove lines/mm.

Comparative Example 2

Figure 13:
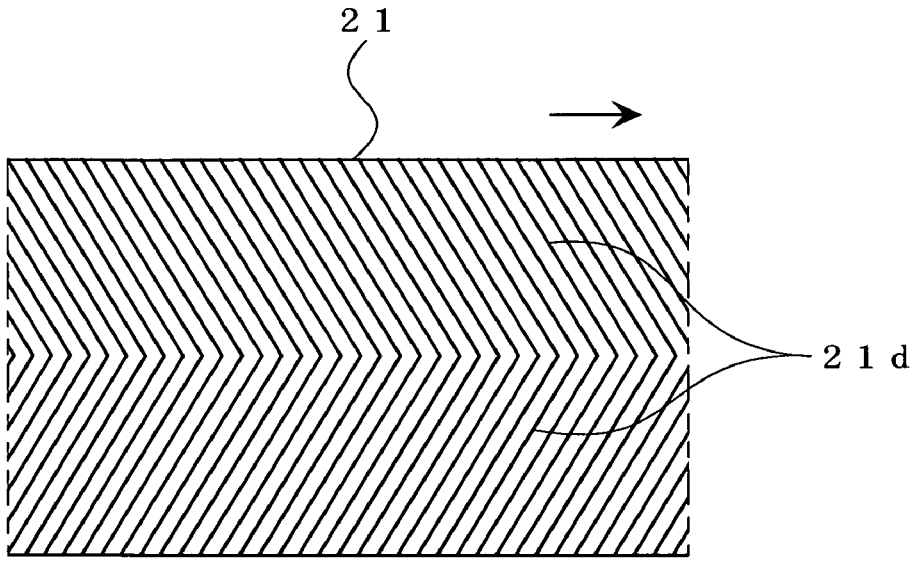
FIG. 13 is a fragmentary view showing grooves formed in an inside surface of a fixing belt according to Comparative Example 2.

In Comparative Example 2, a plurality of grooves 21*d* were formed in the inside surface of the fixing belt 21 as extended from the widthwise center of the fixing belt 21 toward the opposite ends thereof and inclined in the opposite direction to the moving direction thereof, as shown in FIG. 13. The grooves were arranged in the circumferential direction of the fixing belt 21 at predetermined space intervals. The grooves were inclined in the opposite direction to the moving direction at an angle of 5°. The grooves 21*d* had a groove width of 40 μm, a groove depth of 10 μm and a density of 10 groove lines/mm.

Comparative Example 3

Figure 14:
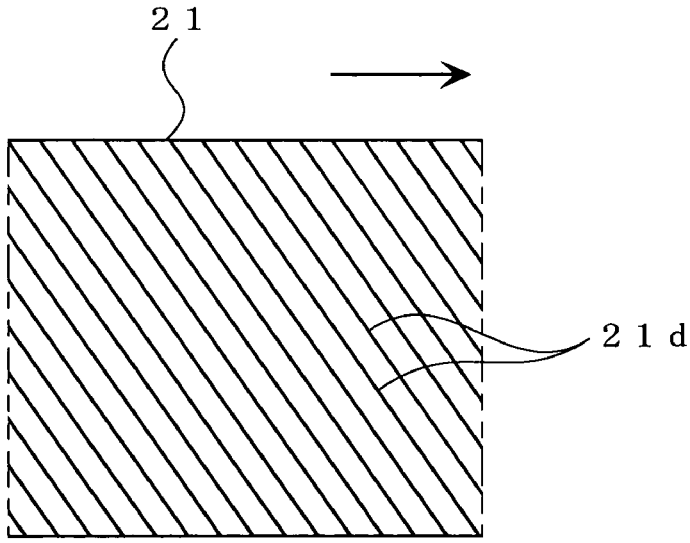
FIG. 14 is a fragmentary view showing grooves formed in an inside surface of a fixing belt according to Comparative Example 3.

In Comparative Example 3, a plurality of grooves 21*d* were formed in the inside surface of the fixing belt 21 as inclined from one widthwise end of the fixing belt 21 toward the other end thereof, as shown in FIG. 14. The grooves were arranged in the circumferential direction of the fixing belt 21 at predetermined space intervals. The grooves 21*d* had a tilt angle of 45°, a groove width of 40 μm, a groove depth of 10 μm and a density of 10 groove lines/mm.

Comparative Example 4

Figure 15:
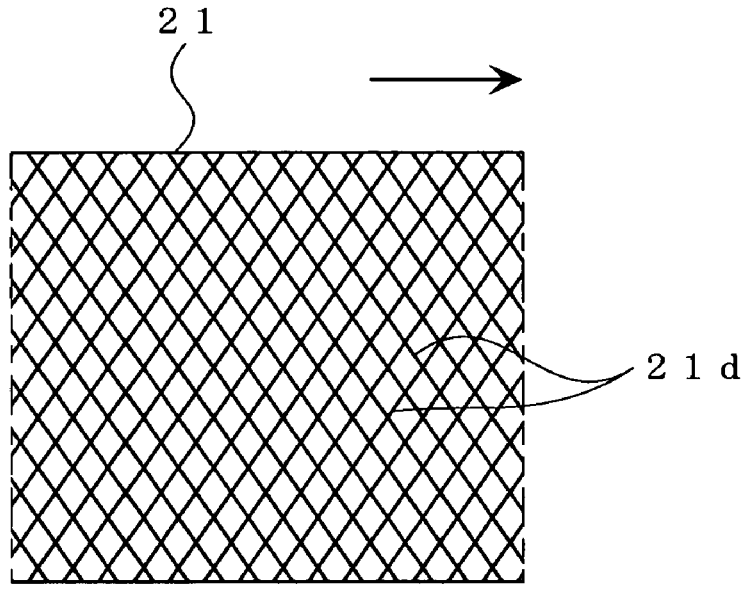
FIG. 15 is a fragmentary view showing grooves formed in an inside surface of a fixing belt according to Comparative Example 4.

In Comparative Example 4, a plurality of grooves 21*d* were formed in the inside surface of the fixing belt 21 in a cross-hatched fashion, as shown in FIG. 15, wherein some grooves were inclined from one widthwise end of the fixing belt 21 toward the other end thereof while the other grooves were inclined in the opposite way. The grooves 21*d* had a tilt angle of 45°, a groove width of 40 μm, a groove depth of 10 μm and a density of 10 groove lines/mm.

A lubricant such as grease was applied to the inside surface of each of the fixing belts 21 of the above Examples 1 to 7 and Comparative Examples 1 to 4. Each of the fixing belts 21 was pressed against the rotating pressure roller 23 by means of the pressing member 22 disposed at place inside of the inside surface of the fixing belt. Each of the fixing belts was determined for the time-related variations of rotational torque when the fixing belt was driven into rotation by way of the rotation of the pressure roller 23. In addition, the transport speed at which the recording medium 9 was transported by the cooperation between the above fixing belt 21 and the pressure roller 23 was set to 150 mm/s and the time-related variation percentages of the transport speed were determined.

Figure 16A:
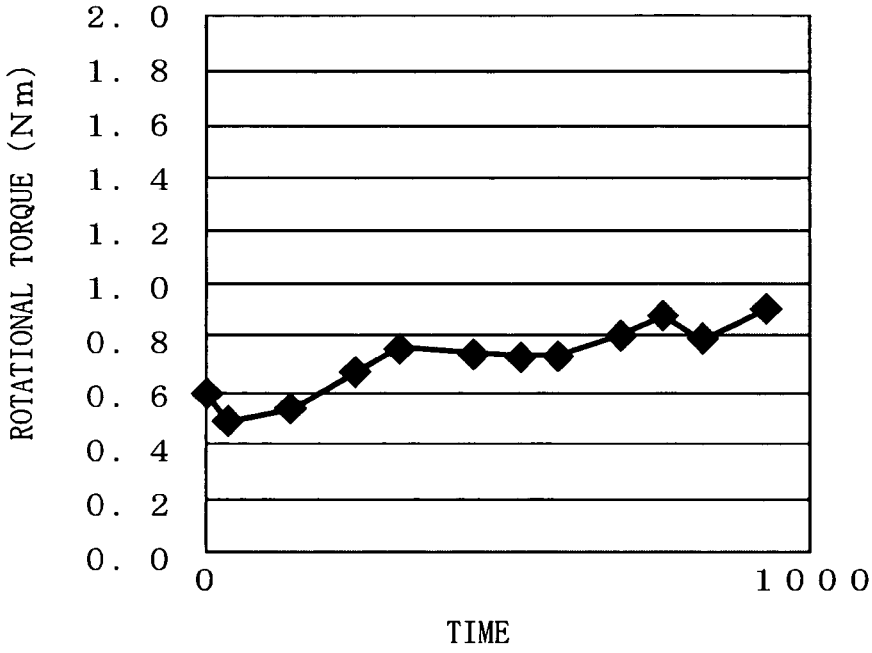
FIGS. 16 A and B are graphs showing the time-related variations of rotational torque and the time-related variation percentages of transport speed, respectively, in a case where the fixing belt of Example 1 is used.
Figure 16B:
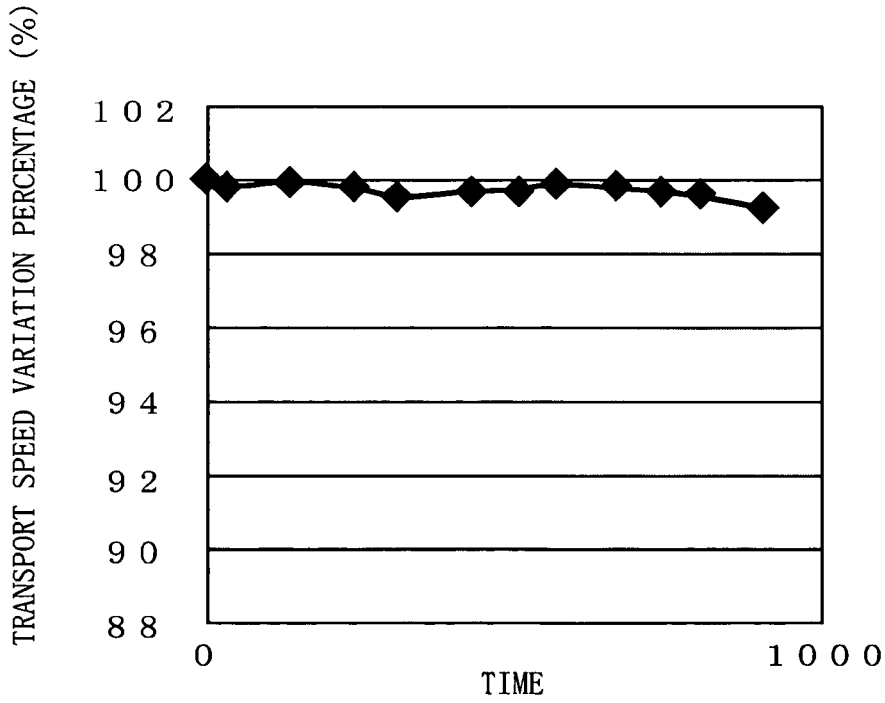
Figure 17A:
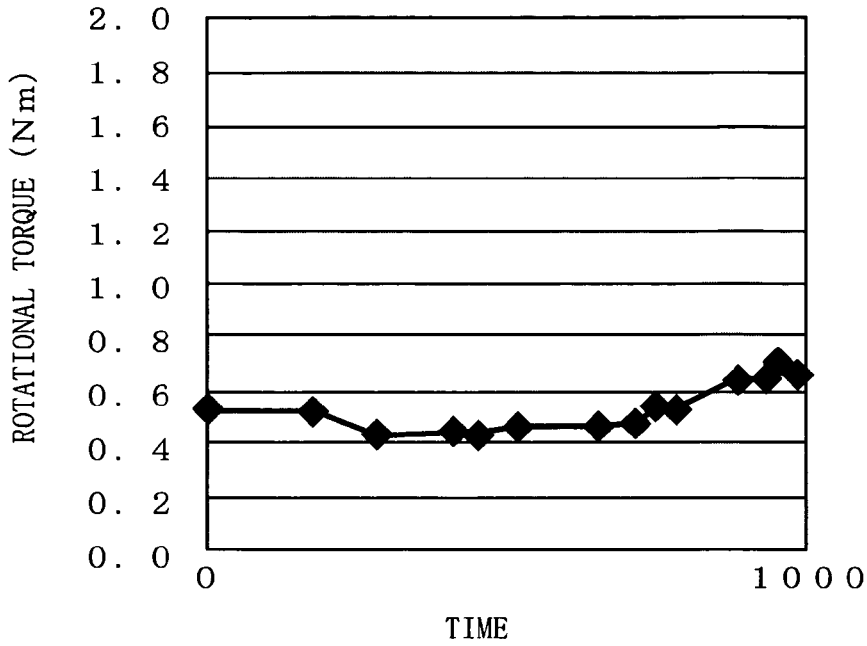
FIGS. 17 A and B are graphs showing the time-related variations of rotational torque and the time-related variation percentages of transport speed, respectively, in a case where the fixing belt of Example 2 is used.
Figure 17B:
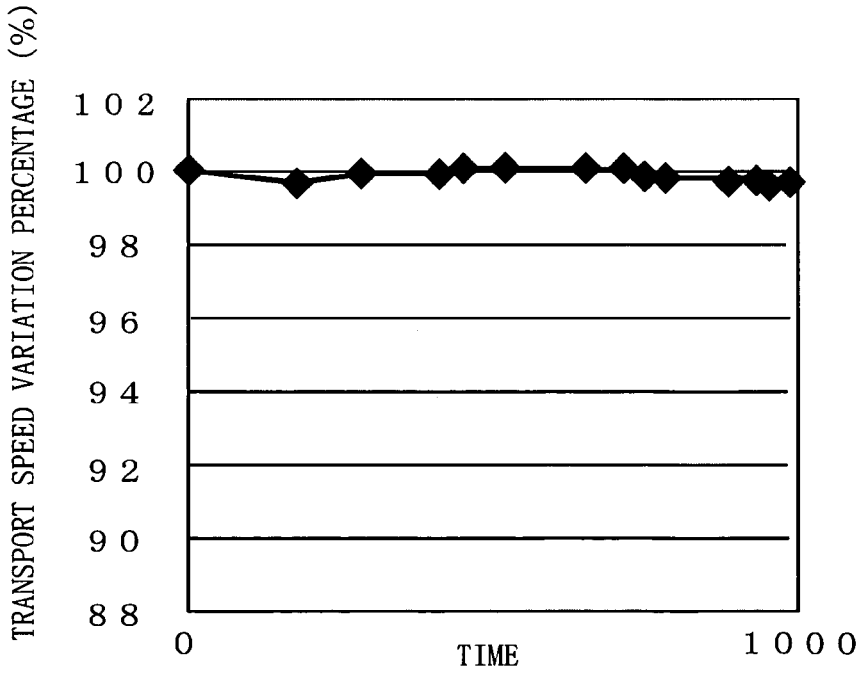
Figure 18A:
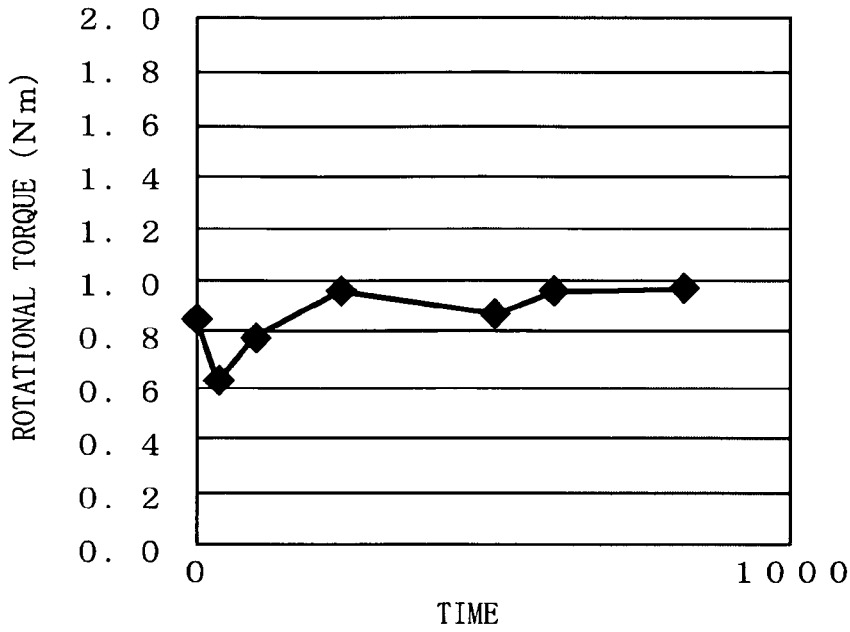
FIGS. 18 A and B are graphs showing the time-related variations of rotational torque and the time-related variation percentages of transport speed, respectively, in a case where the fixing belt of Example 3 is used.
Figure 18B:
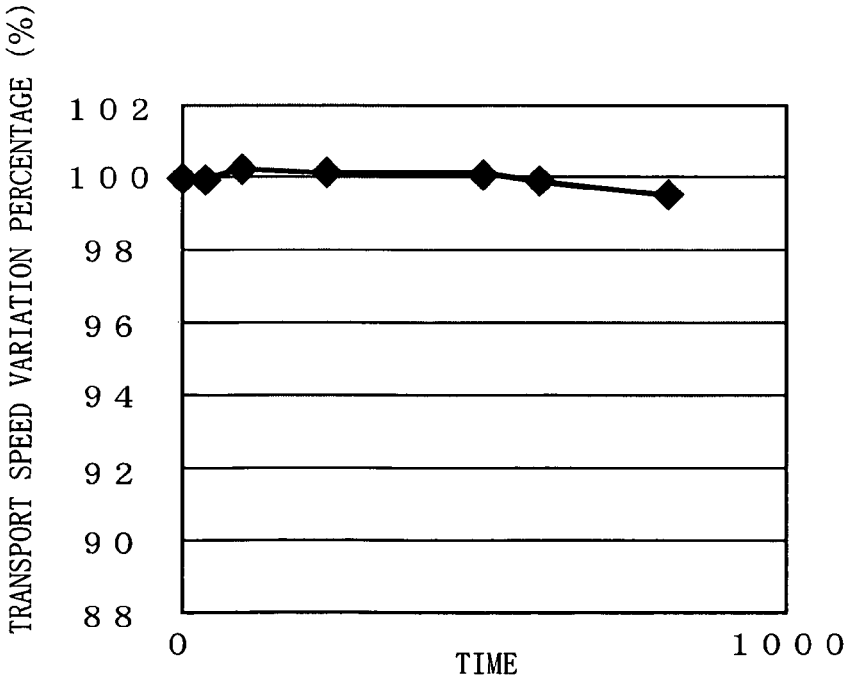
Figure 19A:
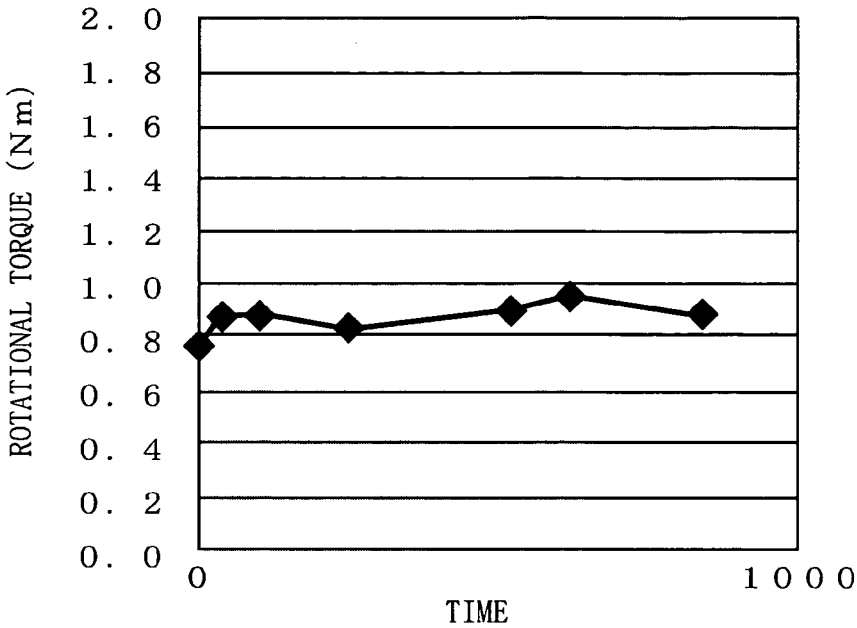
FIGS. 19 A and B are graphs showing the time-related variations of rotational torque and the time-related variation percentages of transport speed, respectively, in a case where the fixing belt of Example 4 is used.
Figure 19B:
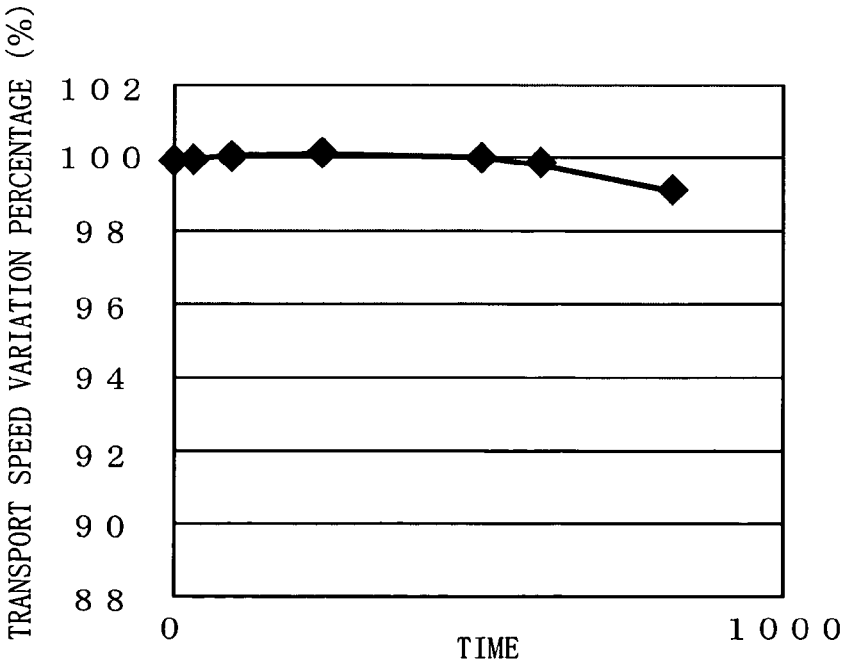
Figure 20A:
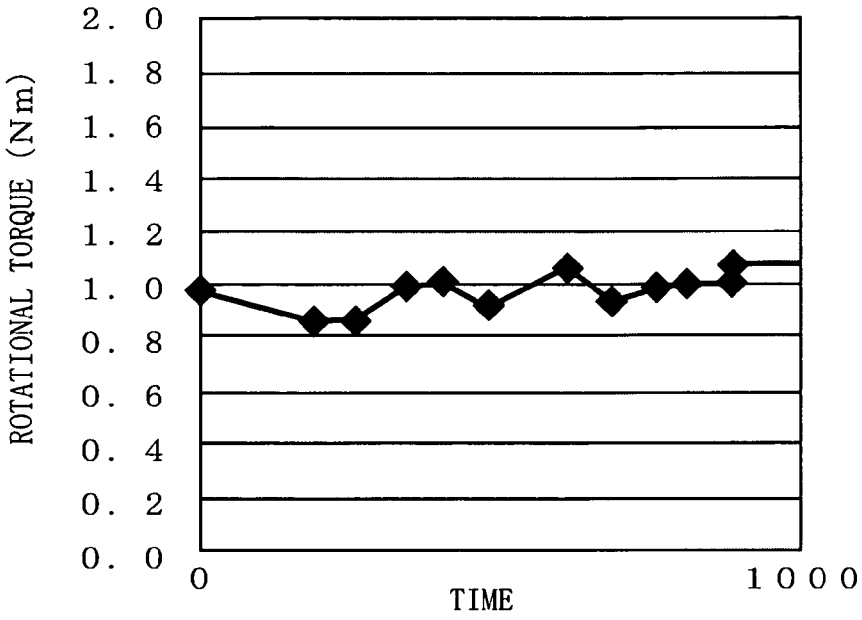
FIGS. 20 A and B are graphs showing the time-related variations of rotational torque and the time-related variation percentages of transport speed, respectively, in a case where the fixing belt of Example 5 is used.
Figure 20B:
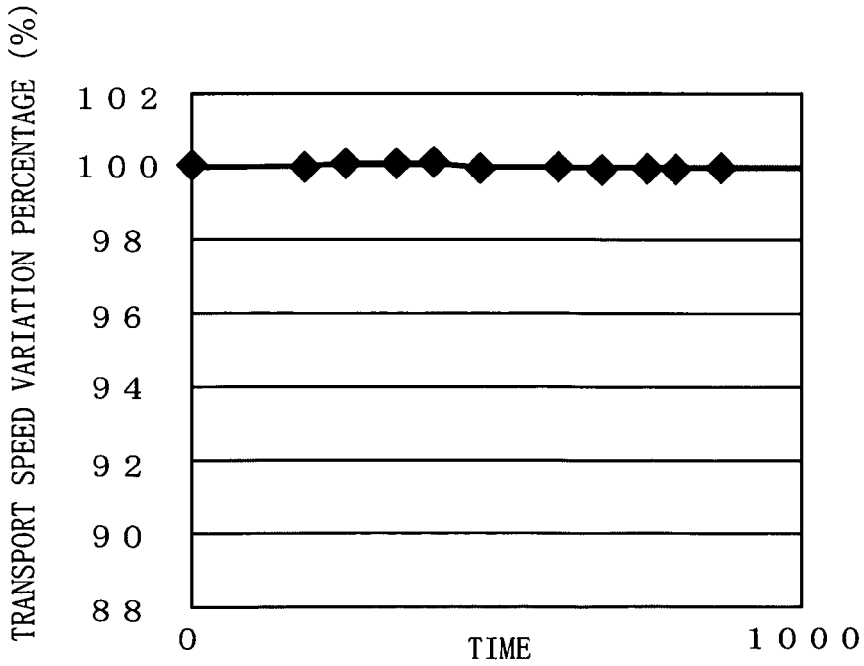
Figure 21A:
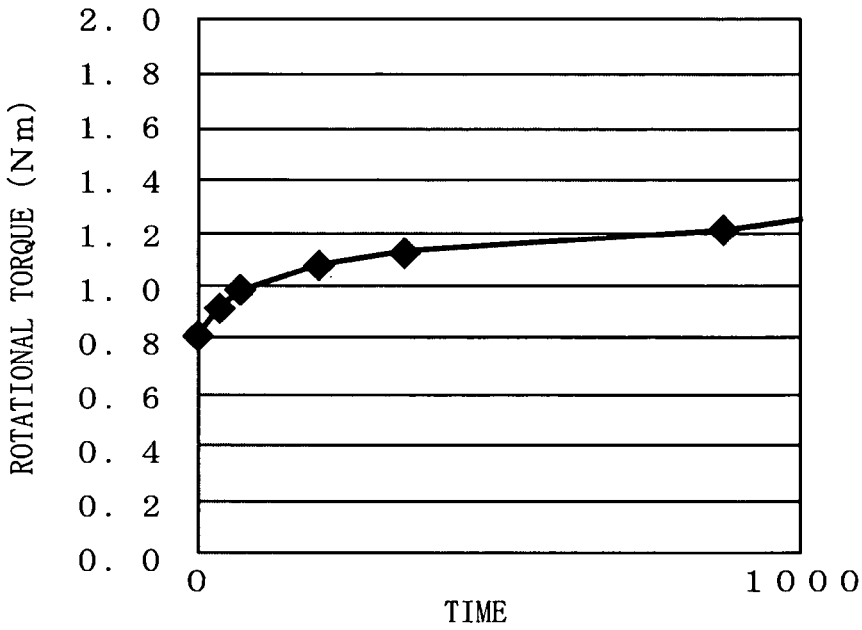
FIGS. 21 A and B are graphs showing the time-related variations of rotational torque and the time-related variation percentages of transport speed, respectively, in a case where the fixing belt of Example 6 is used.
Figure 21B:
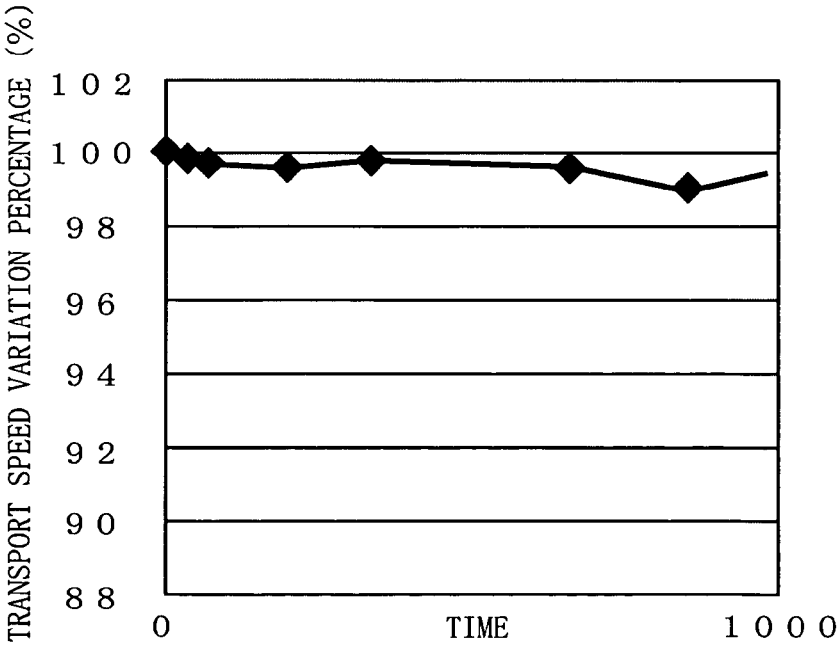
Figure 22A:
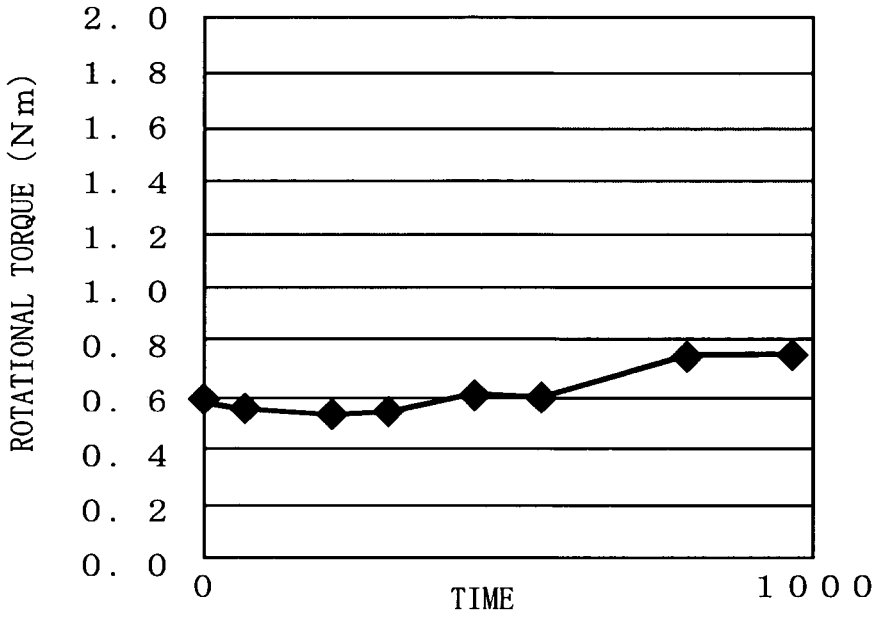
FIGS. 22 A and B are graphs showing the time-related variations of rotational torque and the time-related variation percentages of transport speed, respectively, in a case where the fixing belt of Example 7 is used.
Figure 22B:
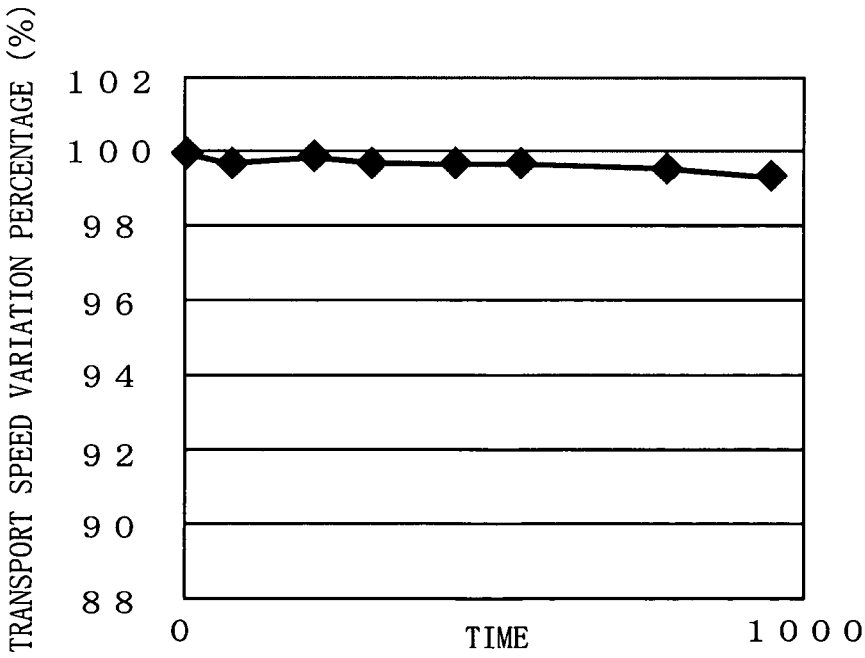
Figure 23A:
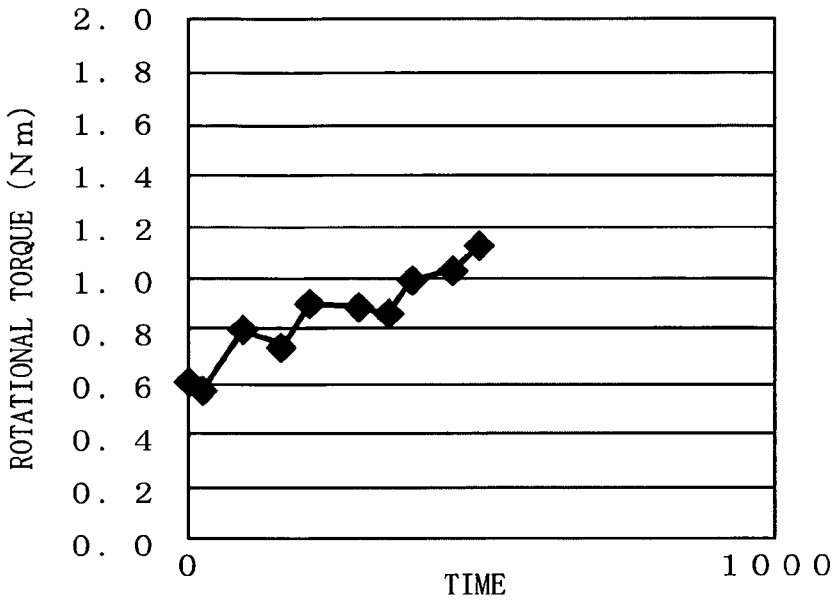
FIGS. 23 A and B are graphs showing the time-related variations of rotational torque and the time-related variation percentages of transport speed, respectively, in a case where the fixing belt of Comparative Example 1 is used.
Figure 23B:
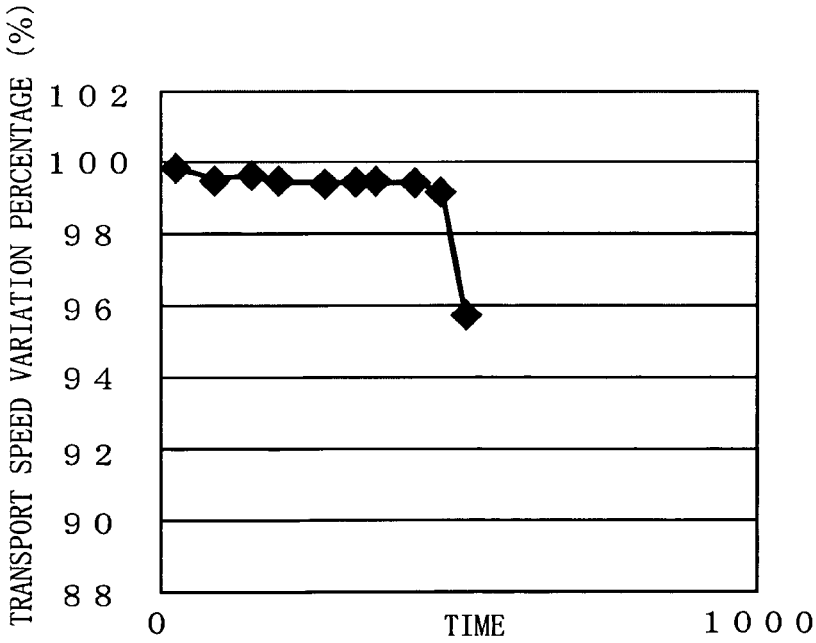
Figure 24A:
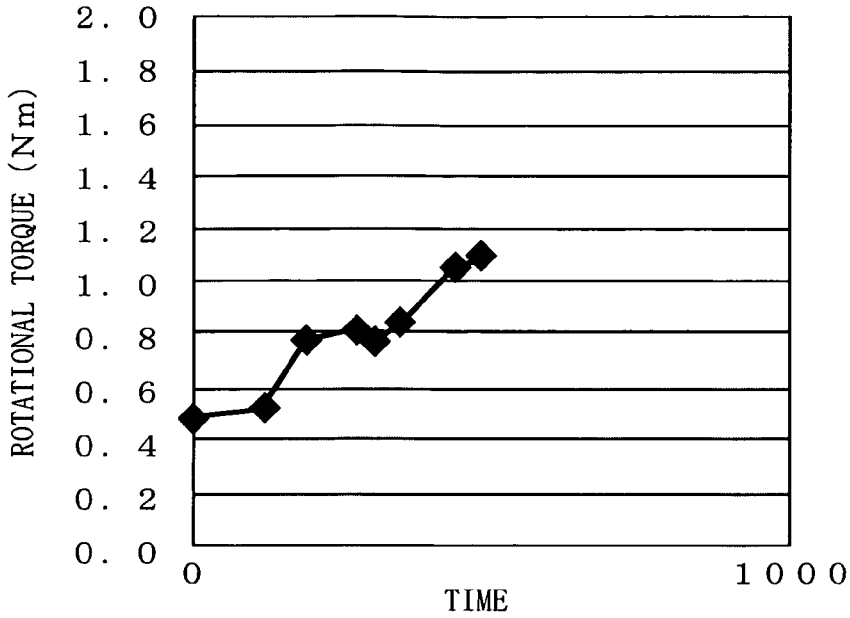
FIGS. 24 A and B are graphs showing the time-related variations of rotational torque and the time-related variation percentages of transport speed, respectively, in a case where the fixing belt of Comparative Example 2 is used.
Figure 24B:
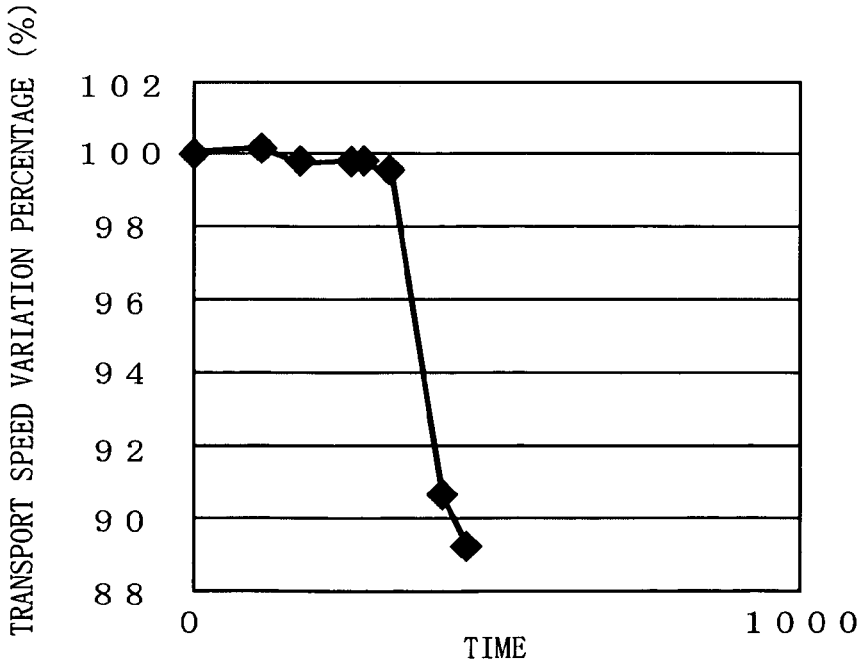
Figure 25A:
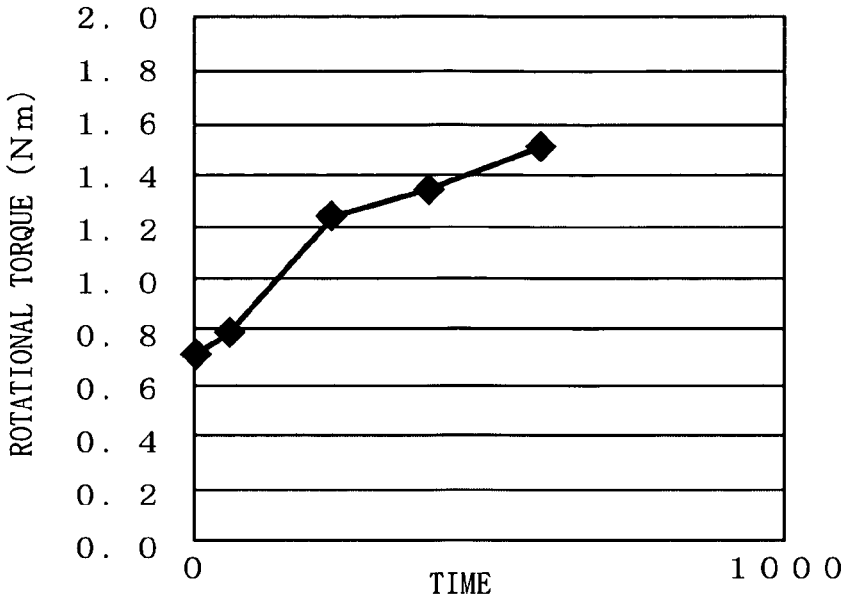
FIGS. 25 A and B are graphs showing the time-related variations of rotational torque and the time-related variation percentages of transport speed, respectively, in a case where the fixing belt of Comparative Example 3 is used.
Figure 25B:
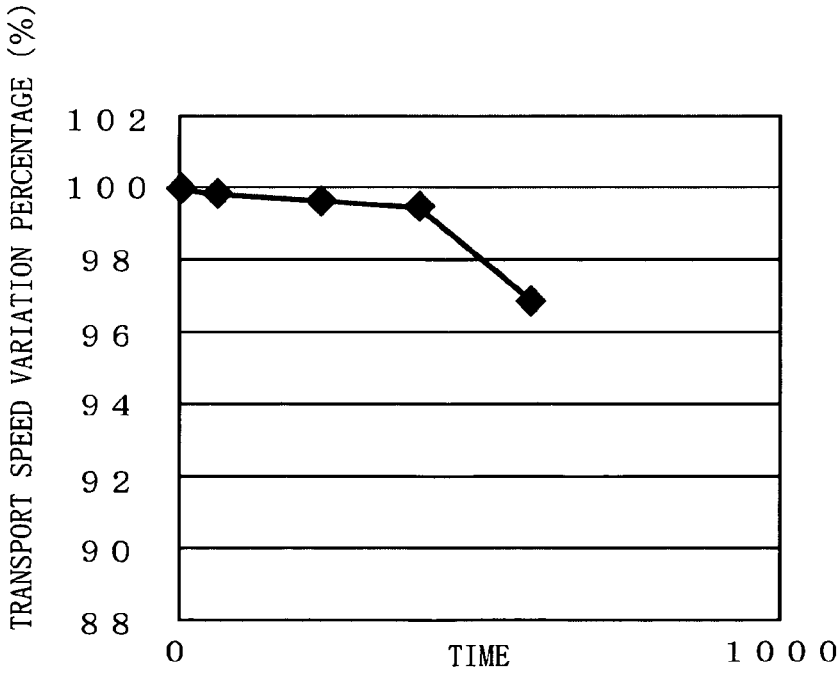
Figure 26A:
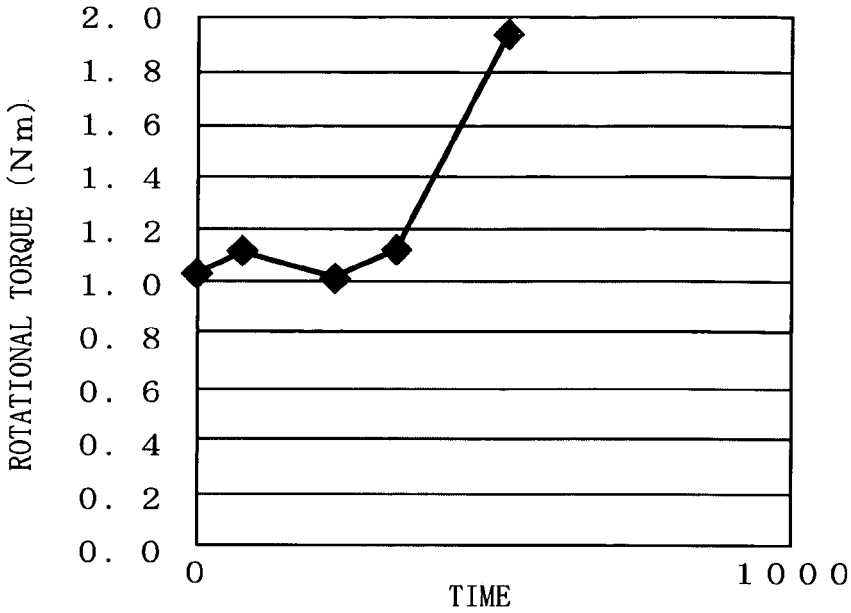
FIGS. 26 A and B are graphs showing the time-related variations of rotational torque and the time-related variation percentages of transport speed, respectively, in a case where the fixing belt of Comparative Example 4 is used.
Figure 26B:
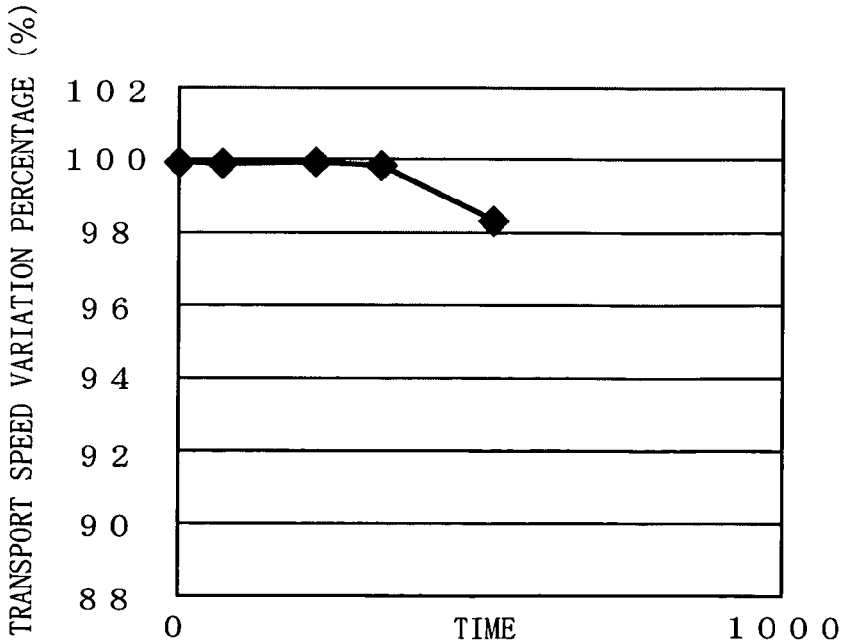

The test results of the above fixing belt of Example 1 are shown in FIG. 16A and FIG. 16B. The test results of the above fixing belt of Example 2 are shown in FIG. 17A and FIG. 17B. The test results of the above fixing belt of Example 3 are shown in FIG. 18A and FIG. 18B. The test results of the above fixing belt of Example 4 are shown in FIG. 19A and FIG. 19B. The test results of the above fixing belt of Example 5 are shown in FIG. 20A and FIG. 20B. The test results of the above fixing belt of Example 6 are shown in FIG. 21A and FIG. 21B. The test results of the above fixing belt of Example 7 are shown in FIG. 22A and FIG. 22B. The test results of the above fixing belt of Comparative Example 1 are shown in FIG. 23A and FIG. 23B. The test results of the above fixing belt of Comparative Example 2 are shown in FIG. 24A and FIG. 24B. The test results of the above fixing belt of Comparative Example 3 are shown in FIG. 25A and FIG. 25B. The test results of the above fixing belt of Comparative Example 4 are shown in FIG. 26A and FIG. 26B.

The results indicate the following facts. Despite the long-term use, the fixing belts of Examples 1 to 7 have smaller variations of the transport speed to transport the recording medium in cooperation with the pressure roller, as compared with the fixing belts of Comparative Examples 1 to 4. In the cases of the fixing belts of Examples 1 to 7, the recording medium is not jammed between the fixing belt and the pressure roller. Thus, the fixing belts of Examples 1 to 7 are adapted to provide the consistent image fixation.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

The invention claimed is:

1. A fixing unit comprising:

an endless fixing belt having an inside surface, the inside surface being adapted to receive a lubricant and having outside edges extending circumferentially about the fixing belt;

a driver for drivingly rotating the fixing belt in a moving rotating direction; and a pressing member for pressing the fixing belt on the inside surface thereof thereby pressing the fixing belt against a recording member;

wherein the fixing belt includes grooves formed in the inside surface thereof, a majority of the grooves extending entirely around the endless fixing belt and along a circumferential direction of the fixing belt and having a width of 10 to 80 μm.

2. A fixing unit according to claim 1, wherein the grooves have a depth of 4 to 30 μm and a density of 5 or more groove lines/mm with respect to the inside surface of the fixing belt.

3. A fixing unit according to claim 1, wherein the majority of the grooves each extend to form a concave shape facing in the forward moving rotating direction of the fixing belt.

4. A fixing unit according to claim 1, wherein all the grooves are extended entirely around the endless fixing belt and along the circumferential direction of the fixing belt.

5. A fixing unit according to claim 1, wherein none of the grooves crosses one another.

6. The fixing unit according to claim 1, wherein all of the grooves are arranged to extend entirely around the endless fixing belt.

7. An image forming apparatus comprising:

an image carrier;

an electrostatic latent image forming unit for forming an electrostatic latent image on the image carrier;

a developing device for forming a toner image on the image carrier by developing the electrostatic latent image;

a transfer unit for transferring the toner image from the image carrier to a recording member; and a fixing unit for fixing the toner image, formed on the recording member, to the recording member, wherein the fixing unit comprises:

an endless fixing belt having a lubricant applied to an inside surface thereof and including grooves formed in the inside surface thereof, a majority of the grooves extending entirely around the endless fixing belt and along a circumferential direction thereof so that lubricant applied to the grooves is prevented from leaking outside edges of the fixing belt;

a driver for drivingly rotating the fixing belt; and a pressing member for pressing the fixing belt on the inside surface thereof thereby pressing the fixing belt against the recording member, wherein the grooves have a width of 10 to 80 μm.

8. An image forming apparatus according to claim 7, wherein all of the grooves extend entirely around the endless fixing belt and along a circumferential direction thereof.

9. An image forming apparatus according to claim 7, wherein none of the grooves crosses one another.

10. The image forming apparatus according to claim 7, wherein all of the grooves are arranged to extend entirely around the endless fixing belt.

11. A fixing belt for use in a fixing unit which drivingly rotates an endless fixing belt having a lubricant applied to an inside surface thereof and which presses the fixing belt against a recording medium formed with a toner image thereon thereby fixing the toner image to the recording medium, wherein the inside surface of the fixing belt is formed with grooves, a majority of the grooves extending entirely around the endless fixing belt and along a circumferential direction of the fixing belt and having a width of 10 to 80 μm.

12. A fixing unit according to claim 11, wherein the majority of the grooves each extend to form a concave shape facing in the forward moving rotating direction of the fixing belt.

13. A fixing belt according to claim 11, wherein all of the grooves are extended entirely around the endless fixing belt and along a circumferential direction of the fixing belt.

14. A fixing belt according to claim 11, wherein none of the grooves crosses one another.

15. The fixing belt according to claim 11, wherein all of the grooves are arranged to extend entirely around the endless fixing belt.

* * * * *